US006191527B1

(12) United States Patent
Kreider, III

(10) Patent No.: US 6,191,527 B1
(45) Date of Patent: Feb. 20, 2001

(54) STRESS RELIEVED FILAMENT SUPPORT ASSEMBLY

(75) Inventor: Paul H. Kreider, III, Lancaster, PA (US)

(73) Assignee: Burle Technologies, Inc., Wilmington, DE (US)

( * ) Notice: Under 35 U.S.C. 154(b), the term of this patent shall be extended for 0 days.

(21) Appl. No.: 09/293,745

(22) Filed: Apr. 16, 1999

(51) Int. Cl.[7] ..... H01J 1/15; H01J 19/08
(52) U.S. Cl. ..... 313/341; 313/344
(58) Field of Search ..... 313/341, 344, 313/337; 315/39.51, 39.67; 331/86

(56) References Cited

U.S. PATENT DOCUMENTS 4,230,968 10/1980 Oguro ..... 315/39.51
4,264,843 4/1981 Hammersand ..... 315/39.51
4,494,034 1/1985 Keller ..... 313/341
4,636,749 1/1987 Thornber ..... 331/90

*Primary Examiner*—Michael H. Day
(74) *Attorney, Agent, or Firm*—Martin Fruitman

(57) ABSTRACT

The structure is an improvement to prevent thermal cycle damage to a braze joint in a magnetron filament assembly. The filament is welded to a molybdenum filament weld ring which, in turn, is brazed to a solid iron filament support cylinder. This braze joint is sometimes broken because of the different thermal expansion coefficients of molybdenum and iron, even though slots are formed in the molybdenum cylinder to reduce the stress. The improvement is the addition of a thin yieldable cylinder along the top outer edge of the iron support cylinder to which the molybdenum cylinder is brazed. This thin cylinder can be constructed by cutting an annular groove adjacent to the top outer edge of the iron support cylinder. The groove then forms the cylinder to which the weld ring is attached, and the thin iron cylinder yields with thermal stress and therefore relieves the stress on the adjacent braze joint.

2 Claims, 3 Drawing Sheets

STRESS RELIEVED FILAMENT SUPPORT ASSEMBLY

BACKGROUND OF THE INVENTION

This invention deals generally with electric lamp and discharge devices and more specifically with the support structure for the filament of an electron tube.

A typical power tube filament operates at a temperature of approximately 2200 degree s centigrade, and this can lead to severe structural problems. Not only is it necessary to support such filaments against structural movement when they are at such high temperatures, but it must be kept in mind that the filaments are not always at that temperature. Since the tubes must be turned on and off for various reasons, the filament will actually vary in temperature from near room temperature up to and including its operating temperature. Moreover, operational considerations require that the tubes must turn on rather quickly, thus causing the temperature of a filament to change at a very rapid rate.

This extreme temperature and dramatic temperature change places severe thermal stress, not only on the filament itself, but on the entire support structure of the filament. This occurs because the support structure generally is subjected to filament temperatures at one of its extremities and, therefore, temperatures throughout the support structure, even remote from the filament, are also very hot.

In a typical high power tube, such as a 90 KW continuous wave magnetron, in which the high power exaggerates the problems, this thermal stress can cause fracture of the typical filament support structure. In that particular type tube, it has been standard practice to use a helically wound tungsten filament. This configuration is supported at its lower end by a molybdenum weld ring which is essentially an inverted cup comprising a planar portion to which is attached a cylindrical side portion. The top of the inverted cup, the planar portion, has a central hole with a lip around the circumference of the hole, and the bottom of the helical filament is welded to this lip. Once assembled, the weld ring looks very much like a skirt attached at the bottom of the helical filament.

The top end of the filament is welded to a disc-like fixture which has a cylindrical protruding lip to which the filament is attached. This top disc is attached to and supported by a conductive rod which passes through the centers of the helical filament, the lower weld ring, and the rest of the filament support structure in order to both support the remote upper end of the filament and to act as an electrical connector for that end.

The lower filament weld ring also acts as the electrical connector at the lower end of the filament to which it is attached. The molybdenum weld ring is itself attached to, supported by, and receives the electrical power for the filament through an iron filament support cylinder around which the lower lip of the cylindrical skirt of the filament weld ring fits.

It is the filament weld ring which is most affected by the thermal stress to which the entire assembly is subjected. The relatively short filament weld ring has the extremely hot temperature of the filament attached to the central lip of its planar portion and the iron filament support cylinder attached to the bottom lip of its cylindrical portion, thereby subjecting the filament support cylinder to heat conducted through the weld ring. It is not uncommon, especially in tubes with high power ratings, for the braze between the filament weld ring and the filament support cylinder to crack because of the differential thermal expansion between the filament weld ring and the filament support cylinder to which it is attached.

This problem is aggravated by the materials required to be used for the various parts. The filament weld ring is typically constructed of molybdenum so that it may be welded to the tungsten filament and also withstand the high temperature, while the filament support cylinder, which is also attached to the filament weld ring, is typically constructed of iron because of the required magnetic properties. Since iron has a dramatic increase in its coefficient of thermal expansion when it rises above 900 degrees C., the increased temperature within the higher power tubes is at least part of the problem for the cracking of the bond between the parts. The iron filament support cylinder expands when heated and contracts when cooled much faster than the molybdenum filament weld ring does, and the braze at their junction tends to crack under the stress of the differential expansion and contraction.

Until now, the only means by which this problem has been alleviated has been to provide the cylindrical side portion of the filament weld ring with slots to relieve the mechanical stress caused by the expanding support cylinder. Such slots permit the fingers formed between them to deflect as heating causes the support cylinder to expand, and prevents the outer cylinder of the weld ring from resisting the expansion.

However, for the higher power tubes now being built, the stress relief afforded by the slotted construction has not been completely effective. The braze between the filament weld ring and the filament support cylinder continues to crack, and the addition of more slots in the skirt of the weld ring is limited by the requirement of the weld ring to conduct large filament currents, thus requiring a large cross sectional area for the conductive path. Additional slots would reduce this cross sectional area.

SUMMARY OF THE INVENTION

The present invention solves the problem of excessive stress on the braze between the filament weld ring and the filament support cylinder by changing the structure of the filament support cylinder, not the filament weld ring.

The structural change is a very simple one. The structure of the prior art filament support cylinder is essentially a solid iron cylinder with a central hole. Such a structure is much stronger than the thin sleeve-like skirt of the filament weld ring which is attached to the outer surface of the filament support cylinder, and the filament support cylinder therefore does not yield even slightly when the differential expansion occurs.

The invention is the addition of a thin yieldable cylinder at the top of the filament support cylinder formed by cutting an annular groove slightly radially inward from the cylindrical surface to which the filament weld ring is attached. This unsupported, short, thin cylinder at the outer edge of the iron filament support cylinder then is the part to which the molybdenum filament weld ring is brazed. The thin iron cylinder is flexible enough, so that it yields to absorb the stress of the differential thermal expansion between it and the weld ring. Thus, the braze at the weld ring is not subjected to as high a level of stress as is present in the tubes without the thin cylinder at the top of the filament support cylinder, and the braze does not crack.

The formation of the thin cylinder by cutting an annular groove in the support cylinder is a convenient construction method, particularly because it maintains the previous magnetic circuit required for operation of the magnetron tube, but the essential structure is the thin, yieldable cylinder to which the filament weld ring is attached. This simple and inexpensive structure can therefore save a complex and very expensive tube from destruction.

DETAILED DESCRIPTION OF THE INVENTION

Figure 1:
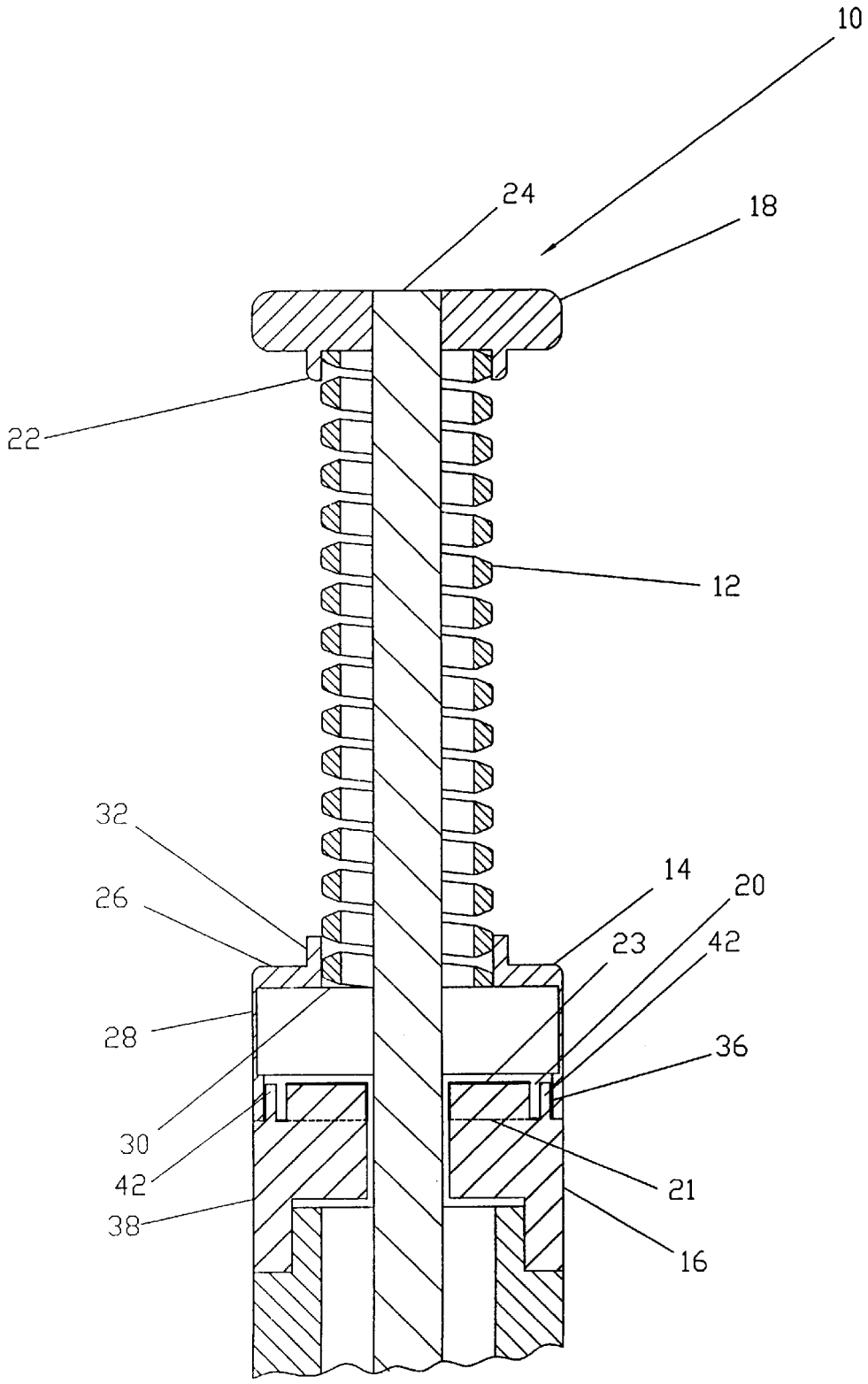
FIG. 1 is a cross section drawing through the axis of a filament assembly of a magnetron tube which includes the invention.

FIG. 1 is a cross section drawing of the preferred embodiment of the invention in which filament assembly 10 is comprised of filament 12, filament weld ring 14, filament support cylinder 16, and upper filament support 18.

Filament 12 is a conventional helical filament which is supported vertically between upper filament support 18 and filament weld ring 14. Upper filament support 18 is essentially a disk with weld lip 22 protruding from its lower surface. Filament 12 is welded to weld lip 22. Upper filament support 18 is attached to central support 24 which functions as one electrical connector for filament 12.

At its lower end, filament 12 is attached to filament weld ring 14 by welding. Weld ring 14 is constructed with a planar surface 26 and a cylindrical skirt 28 to essentially form an inverted cup. Planar surface 26 of weld ring 14 includes central hole 30 through which central support 24 passes, and weld lip 32 is formed to protrude up from planar surface 26 adjacent to central hole 30. Filament 12 is welded to weld ring 14 at weld lip 32.

In conventional tube construction and also in the present invention, as shown in FIG. 1, weld ring 14 is attached to solid support cylinder 16, which is essentially an iron cylinder with central hole 34. Cylindrical skirt 28 of weld ring 14 surrounds and is attached to the upper outer cylindrical surface 36 of support cylinder 16. However, such construction sometimes causes the braze attaching cylindrical skirt 28 and support cylinder 16 to crack.

Figure 2:
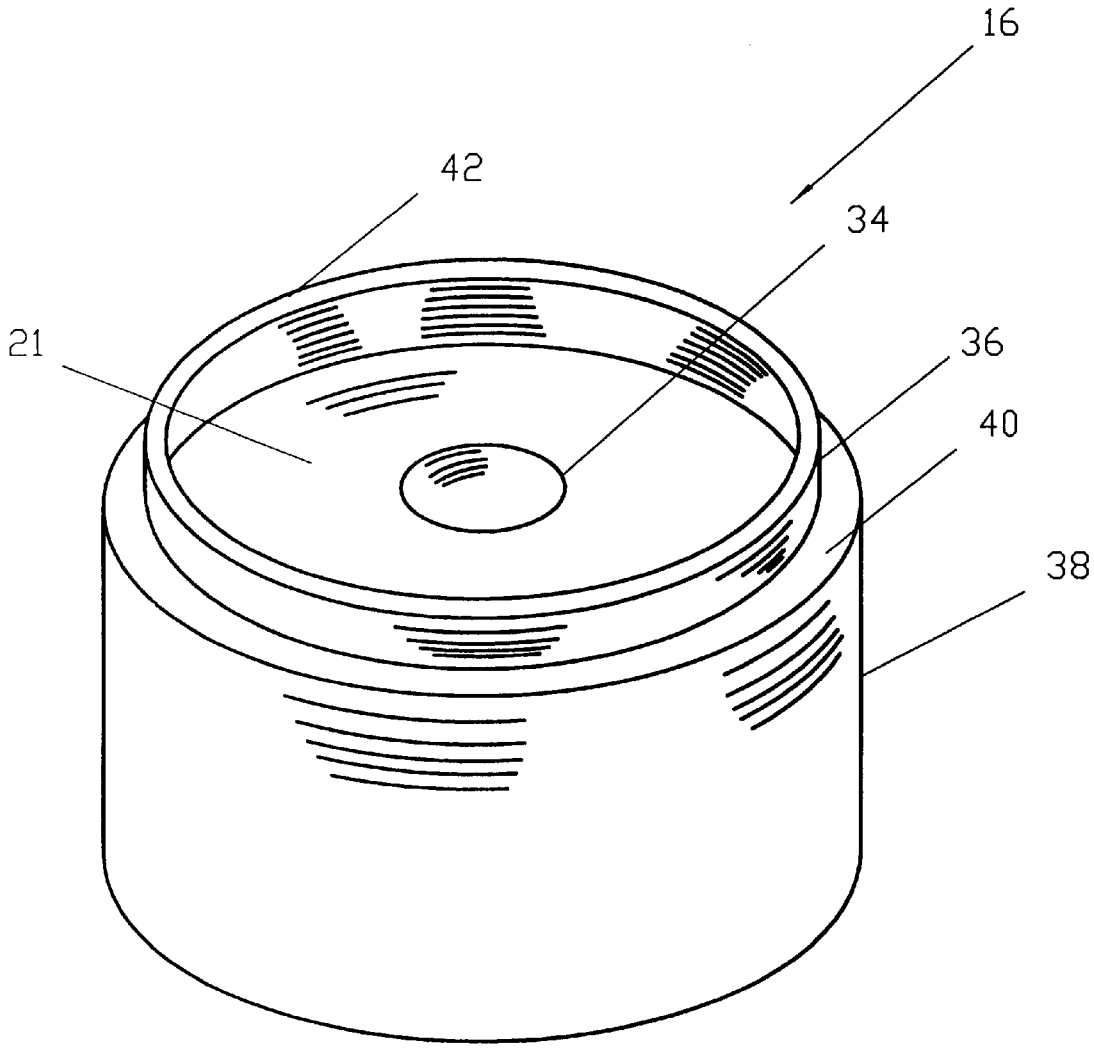
FIG. 2 is a perspective view of the filament support cylinder of the preferred embodiment of the invention.

In the present invention, such problems are prevented by forming thin cylinder 42 extending from lowered top surface 21 of support cylinder 16, and attaching skirt 28 of filament weld ring 14 to thin cylinder 42 as shown in FIG. 1. As shown in FIG. 2, cylinder 42 is thin enough and flexible enough to yield with the stress of the differential thermal expansion between iron support cylinder 16 and molybdenum skirt 28 of filament weld ring 14. It is the fact that cylinder 42 yields with differential thermal expansion that prevents the braze between skirt 28 and support cylinder 16 from cracking.

Figure 3:
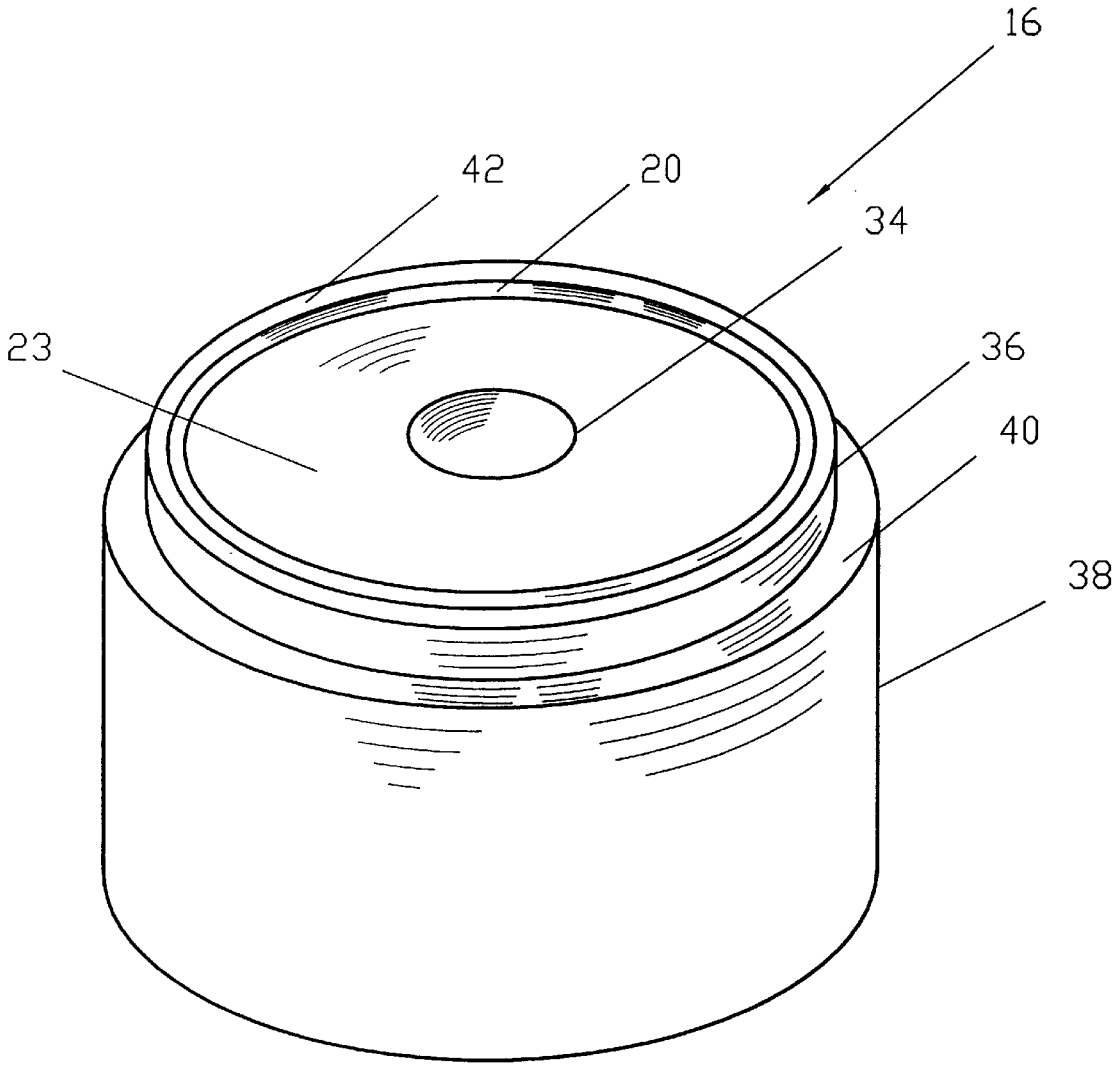
FIG. 3 is a perspective view of the filament support cylinder of an embodiment of the invention in which the the yieldable cylinder is formed by an annular groove on the support cylinder.

One simple method of making thin cylinder 42 is by forming annular groove 20 into original top surface 23 of support cylinder 16. Annular groove 20 is a minor modification to prior art support cylinder 16. As shown in FIGS. 2 and 3, support cylinder 16 has a top section 36 which is slightly smaller in diameter than bottom section 38. This difference in diameter forms shelf 40 which permits a continuous smooth exterior surface of the two cylinders when skirt 28 and support cylinder 16 are assembled.

In the embodiment of the invention shown in FIGS. 1 and 3, annular groove 20 is located radially inward from outer surface 36 of support cylinder 16 to which skirt 28 is attached. When annular groove 20 is formed into original top surface 23 of support cylinder 16, annular groove 20 extends down into support cylinder 16 to approximately the same depth as shelf 40, and therefore is essentially behind the region of support cylinder 16 to which skirt 28 attaches.

In the embodiment shown in FIG. 3, in a 90 KW magnetron with a filament current of 120 amps, the diameter of original top surface 23 of support cylinder 16 is 0.92 inch, the width of annular groove 20 is 0.050 inch, the wall thickness of thin cylinder 42 is 0.035 inch, and the depth of annular groove 20 is 0.120 inch. Groove 20 thereby forms thin radially unsupported cylinder 42 attached to support cylinder 16.

The wall thickness of thin cylinder 42 is typically chosen to be approximately the same thickness as the lower portion of skirt 28 of molybdenum weld ring 14. It should be appreciated that, although the basis of the stress relief of the invention is the yieldable structure of thin cylinder 42, the additional iron material available within the body of support cylinder 16 because of the use of groove 20 and original top surface 23 instead of lowered top surface 21 is desirable in order to maintain the magnetic characteristics of the magnetron tube into which the invention is installed.

Thus, the simple modification of forming an annular groove in filament support cylinder 16 behind the surface to which filament weld ring 14 is attached, solves the recurrent problem of cracking the braze which attaches the parts.

It is to be understood that the form of this invention as shown is merely a preferred embodiment. Various changes may be made in the size and arrangement of parts; equivalent means may be substituted for those illustrated and described; and certain features may be used independently from others without departing from the spirit and scope of the invention as defined in the following claims.

What is claimed as new and for which Letters Patent of the United States are desired to be secured is:

1. In a tube filament assembly of the type which includes a filament structure; a weld ring comprising a first surface to which the filament structure is attached and away from which the filament structure extends, with a skirt attached to the outer perimeter of the first surface and extending away from the first surface of the weld ring in a direction opposite from the filament structure; and a filament support means with a cylindrical surface and a top surface transverse to the cylindrical surface, with the cylindrical surface of the filament support means fitting into and attached to the skirt of the weld ring with the top surface of the filament support means located within the skirt, the improvement comprising:

a cylinder extending from the top surface of the filament support means, the cylinder located so that it is the part of the filament support means to which the skirt is attached and the cylinder being sufficiently thin and yieldable to counteract the stress developed by differential thermal expansion of the parts and to prevent cracking of the attachment between the support cylinder and the weld ring.

2. In a tube filament assembly of the type which includes a filament structure; a weld ring comprising a first surface to which the filament structure is attached and away from which the filament structure extends, with a skirt attached to the outer perimeter of the first surface and extending away from the first surface of the weld ring in a direction opposite from the filament structure; and a filament support means with a cylindrical surface and a top surface transverse to the cylindrical surface, with the cylindrical surface of the filament support means fitting into and attached to the skirt of the weld ring with the top surface of the filament support means located within the skirt, the improvement comprising:

an annular groove formed into the top surface of the filament support means, the groove located adjacent to the location at which the skirt is attached to the filament support means and forming a cylinder attached to the filament support means at the location to which the skirt is attached, with the cylinder being sufficiently thin and yieldable to counteract the stress developed by differential thermal expansion of the parts and to prevent cracking of the attachment between the support cylinder and the weld ring.

* * * * *